US009038821B2

(12) United States Patent
Proulx

(10) Patent No.: US 9,038,821 B2
(45) Date of Patent: May 26, 2015

(54) PORTABLE GOLF CLUB CARRIER

(71) Applicant: Robert Proulx, West Babylon, NY (US)

(72) Inventor: Robert Proulx, West Babylon, NY (US)

( * ) Notice: Subject to any disclaimer, the term of this patent is extended or adjusted under 35 U.S.C. 154(b) by 92 days.

(21) Appl. No.: 13/649,386

(22) Filed: Oct. 11, 2012

(65) Prior Publication Data

US 2013/0092572 A1 Apr. 18, 2013

Related U.S. Application Data

(60) Provisional application No. 61/546,291, filed on Oct. 12, 2011.

(51) Int. Cl.

| | |
|---|---|
| ***A63B 55/00*** | (2006.01) |
| ***A63B 47/00*** | (2006.01) |
| ***A63B 55/10*** | (2006.01) |

(52) U.S. Cl.

CPC ..... *A63B 47/002* (2013.01); *A63B 55/10* (2013.01); *A63B 2225/093* (2013.01)

(58) Field of Classification Search

CPC ..... A63B 55/00; A63B 55/10; A63B 47/002
USPC ..... 206/315.2, 315.7, 315.9; 211/70.2; 473/282; 280/645

See application file for complete search history.

(56) References Cited

U.S. PATENT DOCUMENTS

| | | | | | |
|---|---|---|---|---|---|
| 646,869 | A | * | 4/1900 | Perles | 206/315.2 |
| 699,391 | A | * | 5/1902 | Johnson | 211/70.2 |
| 1,696,062 | A | | 12/1928 | Thurlow et al. | |
| 2,091,298 | A | | 8/1937 | Agnew | |
| 2,577,333 | A | * | 12/1951 | Klum | 211/70.2 |
| 2,970,629 | A | * | 2/1961 | Masten | 206/315.2 |
| 3,455,358 | A | | 7/1969 | Kuzma | |
| 3,465,993 | A | * | 9/1969 | Muehlhausen | 248/96 |
| 3,954,239 | A | * | 5/1976 | Kerbs, Jr. | 248/96 |
| 4,172,484 | A | | 10/1979 | Henning | |
| 4,792,152 | A | * | 12/1988 | Carolan | 280/47.26 |
| 4,834,444 | A | * | 5/1989 | Young | 294/143 |
| 4,911,292 | A | | 3/1990 | Airey, Jr. | |
| 5,417,334 | A | * | 5/1995 | Wu | 211/70.2 |
| 5,425,452 | A | * | 6/1995 | Shanks et al. | 206/315.7 |
| 5,465,839 | A | | 11/1995 | Gretz | |
| 5,472,084 | A | | 12/1995 | Aliano, Jr. | |
| 5,573,122 | A | | 11/1996 | Williams | |
| 5,775,352 | A | * | 7/1998 | Obitts | 135/69 |
| 6,330,944 | B1 | | 12/2001 | DeMichele | |
| 6,471,055 | B1 | * | 10/2002 | Kwiecienski | 206/315.7 |
| 6,640,970 | B1 | * | 11/2003 | Townsend, Jr. | 206/315.2 |
| 7,628,270 | B1 | | 12/2009 | Davis | |
| 7,673,641 | B2 | * | 3/2010 | Karasin et al. | 135/85 |
| 2004/0026279 | A1 | | 2/2004 | Miller | |
| 2004/0198527 | A1 | * | 10/2004 | Hsieh | 473/282 |
| 2008/0006547 | A1 | * | 1/2008 | Pace | 206/315.2 |

* cited by examiner

*Primary Examiner* — Sue A Weaver

(74) *Attorney, Agent, or Firm* — Buckingham, Doolittle & Burroughs, LLC

(57) ABSTRACT

A golf caddie device is disclosed that is designed for carrying golf equipment. The golf caddie device comprises a support rod having a spike and an ergonomically shaped handle. The golf caddie device also comprises a ball holder, a first cylinder comprising up to five openings for retaining golf clubs, and a second cylinder comprising up to five openings for retaining golf club shafts. Golf clubs are inserted into the golf caddie device by inserting the shaft part of the golf club through one of the first cylinder openings and into one of the openings of the second cylinder, thus, retaining the golf clubs within the golf caddie device.

10 Claims, 6 Drawing Sheets

PORTABLE GOLF CLUB CARRIER

CROSS-REFERENCE

This application claims priority from Provisional Patent Application Ser. No. 61/546,291 filed Oct. 12, 2011.

BACKGROUND

Golfers typically have to carry a large, bulky golf bag, which can be extremely heavy and/or awkward to transport. This may cause the golfer to experience fatigue, as well as injury. Additionally, golfers often only use a few golf clubs when golfing, as opposed to a complete set. The necessary golf clubs end up being laid on the course due to the lack of a suitable carrier. This can lead to the golf clubs being dirtied, damaged, or lost. A more efficient option is needed.

There is a need for an improved golf caddie device that provides users with a bag-less, lightweight, adjustable golf caddie. The present invention discloses a golf caddie device that can be utilized by individuals of all ages. The golf caddie device is designed to hold up to five different clubs, and includes a golf ball dispenser that holds up to five golf balls. It will also have a place to hold golf tees and other accessories, and may also comprise wheels for easy portability. Consumers will appreciate this lightweight, convenient alternative to conventional golf bags.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a golf caddie device that is designed for carrying golf equipment. The golf caddie device comprises a support rod comprising a first end and a second end. The golf caddie device further comprises a spike secured to the second end of the support rod. The spike retracts or folds up when not in use. The support rod also comprises an ergonomically shaped handle secured to the first end, and a first cylinder comprising up to five smaller openings for retaining up to five golf clubs.

In a preferred embodiment, the golf caddie device also comprises a second cylinder. The second cylinder comprises up to five openings for retaining up to five golf club shafts in place. Golf clubs are inserted through the five smaller openings of the first cylinder by inserting the shaft part of the golf club through the smaller openings and into the indentations of the second cylinder, thus, allowing the head part of the golf club to protrude from the smaller openings, and retaining the golf club shaft within the indentations of the second cylinder.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
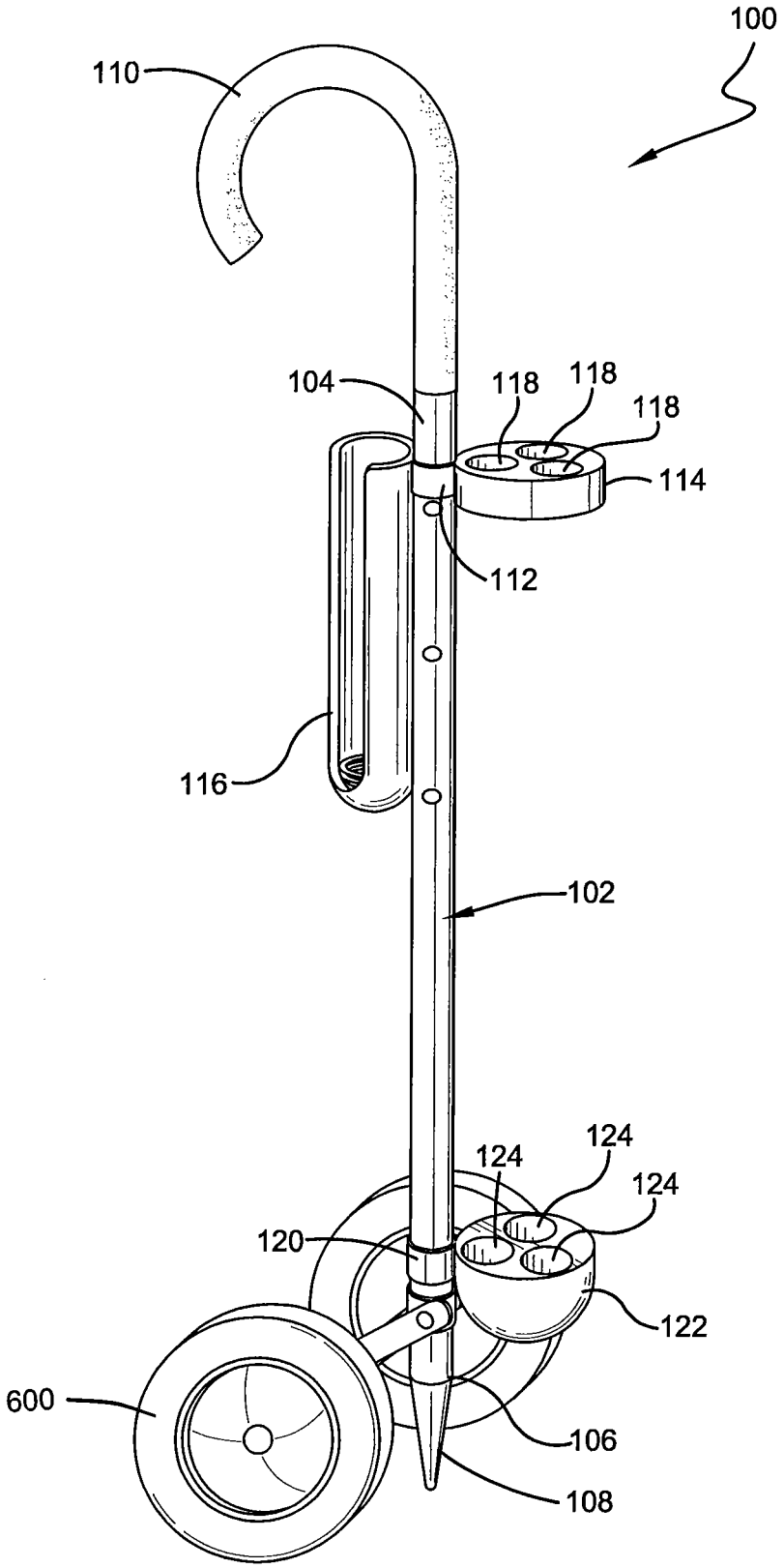
FIG. 1 illustrates a perspective view of a golf caddie device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a golf caddie device that provides users with a bag-less, lightweight, adjustable device for transporting golf clubs, golf balls and other golf accessories. The golf caddie device comprises a support rod having a spike and an ergonomically shaped handle. The golf caddie device also comprises a first cylinder for retaining at least one golf club and a ball holder and a second cylinder for retaining at least one golf club shaft. The first cylinder comprises up to five smaller openings for retaining at least one golf club. The second cylinder comprises up to five smaller indentations for retaining at least one golf club shaft. Golf clubs are inserted into the golf caddie device by inserting the shaft part of the golf club through the smaller openings and into the indentations, thus, retaining the golf clubs within the golf caddie device.

Thus, the golf caddie device can be utilized by individuals of all ages. The golf caddie device is designed to hold up to five different clubs, and includes a golf ball dispenser that holds up to five golf balls. Consumers will appreciate this lightweight, convenient alternative to conventional golf bags.

Figure 6:
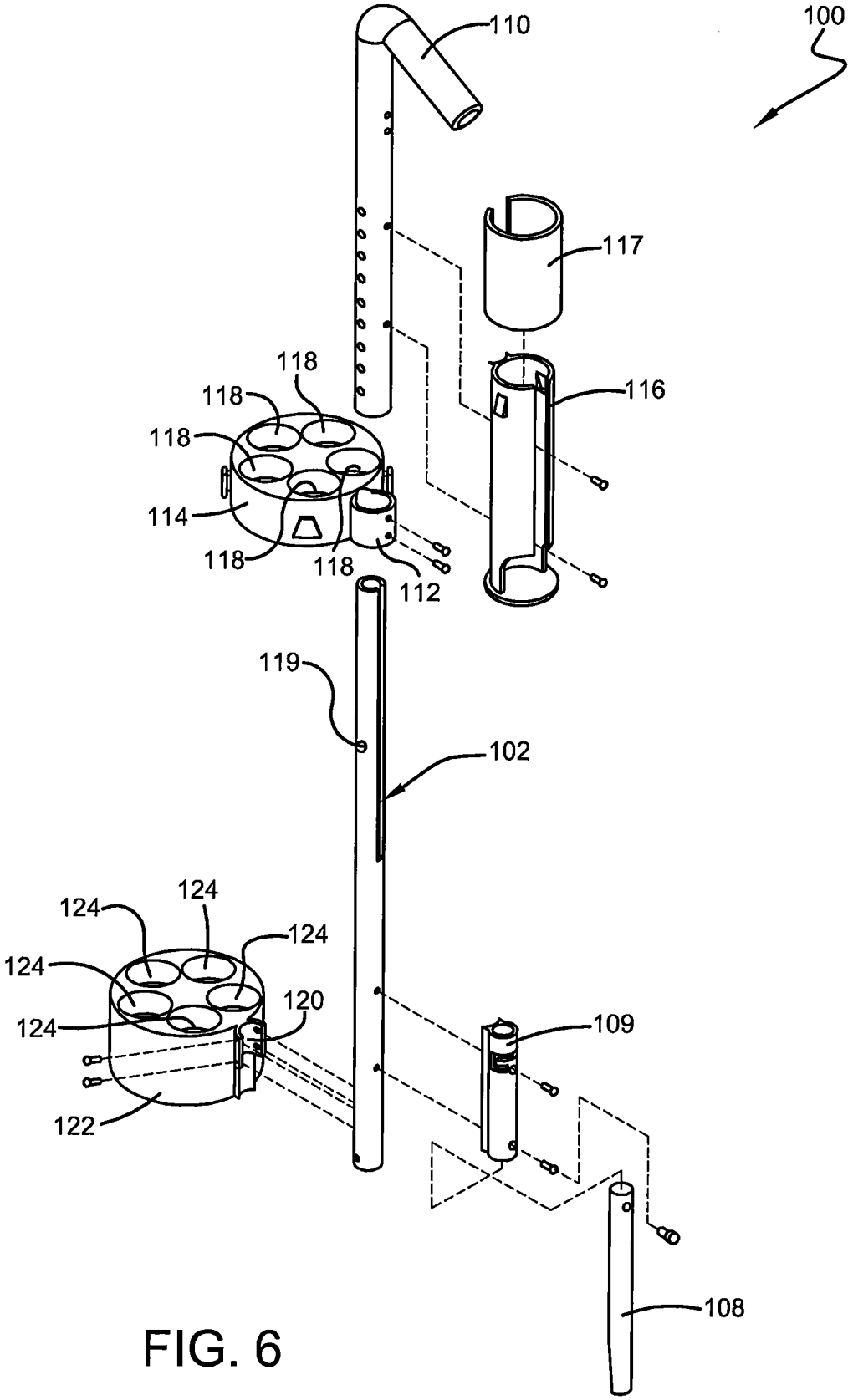
FIG. 6 illustrates a perspective, exploded view of the golf caddie device in accordance with the disclosed architecture.

Referring initially to the drawings, FIGS. 1 and 6 illustrate a golf caddie device 100 that is designed for transporting golf equipment such as golf clubs, balls, golf tees, and accessories. The golf caddie device 100 comprises a support rod 102 comprising a first end 104 and a second end 106. Typically, the support rod 102 is cylindrical in shape such as a dowel rod, however any other suitable shape can be used as is known in the art without affecting the overall concept of the invention.

The support rod 102 would generally be constructed of aluminum or plastic, such as polycarbonate, polyvinyl chloride (PVC), or acrylonitrile butadiene styrene (ABS), though any other suitable material may be used to manufacture the support rod 102 as is known in the art without affecting the overall concept of the invention. The support rod 102 is approximately between 24 and 48 inches long as measured from the first end 104 to the second end 106, and approximately between 1.0 and 3.5 inches in diameter.

The support rod 102 further comprises a spike 108 secured to the second end 106. The spike 108 is secured to the second end 106 of the support rod 102 via gluing, set screws, slide bolts, threading, welding, etc., or any other suitable fastening means as is known in the art. Furthermore, the spike 108 retracts or folds up when not in use to avoid injury or damage. The spike 108 is folded up into or against the support rod 102 via a hinge, a slide bolt 109 (See FIG. 6), or telescopic connection, etc., or any other suitable folding means as is known in the art. Thus, the spike 108 is repositionable between an open position and a closed position, wherein the open position is the spike 108 extended from the support rod 102 and the closed position is the spike 108 folded up into or against the support rod. The spike 108 would generally be constructed of aluminum or plastic, such as polycarbonate, polyvinyl chloride (PVC), or acrylonitrile butadiene styrene (ABS), though any other suitable material may be used to manufacture the spike 108 as is known in the art without affecting the overall concept of the invention.

The spike 108 allows the golf caddie device 100 to be inserted into the ground (not shown). Thus, a user would utilize the spike 108 to allow the golf caddie device 100 to be set into the ground and remain relatively level while golfing. Further, when the user is done golfing with the golf caddie device 100 or desires to transport the golf caddie device 100 to another location, the user would disengage spike 108 from the ground and fold up or retract the spike 108 and transport the golf caddie device 100.

Additionally, the support rod 102 comprises an ergonomically shaped handle 110 secured to the first end 104. The handle 110 is secured to the first end 104 of the support rod 102 via gluing, set screws, threading, welding, etc., or any other suitable fastening means as is known in the art. Typically, the handle 110 is angular (See FIG. 6), or cane-like or hook-like in shape to promote easy handling of device 100, however any other suitable shape can be used as is known in the art without affecting the overall concept of the invention. The handle 110 would generally be constructed of aluminum or plastic, such as polycarbonate, polyvinyl chloride (PVC), or acrylonitrile butadiene styrene (ABS), though any other suitable material may be used to manufacture the handle 110 as is known in the art without affecting the overall concept of the invention. The handle 110 assists users in walking a golf course or other area while carrying the golf caddie device 100.

Furthermore, the support rod 102 is adjustable in length. In one embodiment, the support rod 102 comprises multiple components which allow the support rod to be adjustable. The support rod 102 would be adjusted via a telescopic connection between the multiple components, or a turnbuckle connection between the multiple components, or the multiple components could be of varying length and would then be interchangeable, thus allowing a user to adjust the length of the support rod 102, or the support rod 102 would be adjustable via any other suitable adjusting means as is known in the art. In a preferred embodiment, the support rod 102 comprises a telescopic connection on the support rod 102. Specifically, the support rod is adjusted via a push pin 119 that when pressed allows the support rod 102 to telescope into or out, which adjusts the length of the support rod 102. (See FIG. 6) Thus, the support rod 102 is adjustable for users of varying heights.

The golf caddie device 100 further comprises a first cylinder 114 for retaining at least one golf club (not shown), wherein the first cylinder 114 is secured to the first end 104 of the support rod 102. The first cylinder 114 is secured to the first end 104 of the support rod 102 via a fastening clasp 112, frictional engagement, gluing, set screws, threading, welding, etc., or any other suitable fastening means as is known in the art. Typically, the first cylinder 114 is ring-like or circular in shape, however any other suitable shape can be used as is known in the art without affecting the overall concept of the invention. The first cylinder 114 would generally be constructed of aluminum or plastic, such as polycarbonate, polyvinyl chloride (PVC), polycarbonate (PC), or acrylonitrile butadiene styrene (ABS), though any other suitable material may be used to manufacture the first cylinder 114 as is known in the art without affecting the overall concept of the invention.

Typically, the first cylinder 114 retains at least one golf club. The first cylinder 114 can also retain any other golf accessories as is known in the art such as golf towels, umbrellas, golf tees, ball markers, divot tools, a club head brush, etc. Further, the support rod 102 comprises a ball holder and/or dispenser 116 which retains and dispenses multiple golf balls, typically four to five golf balls, though any suitable number can be retained as is known in the art. The ball holder/dispenser 116 is spring-loaded such that when one golf ball is removed from the dispenser 116 another golf ball will rise up toward the top of the dispenser 116. Typically, the ball holder/dispenser 116 comprises a spring-loaded mechanism as is known in the art. In a preferred embodiment, the ball holder comprises a sleeve 117 (See FIG. 6) which covers the ball holder 116, once the sleeve 117 is raised golf balls would be released or dispensed.

Figure 4:
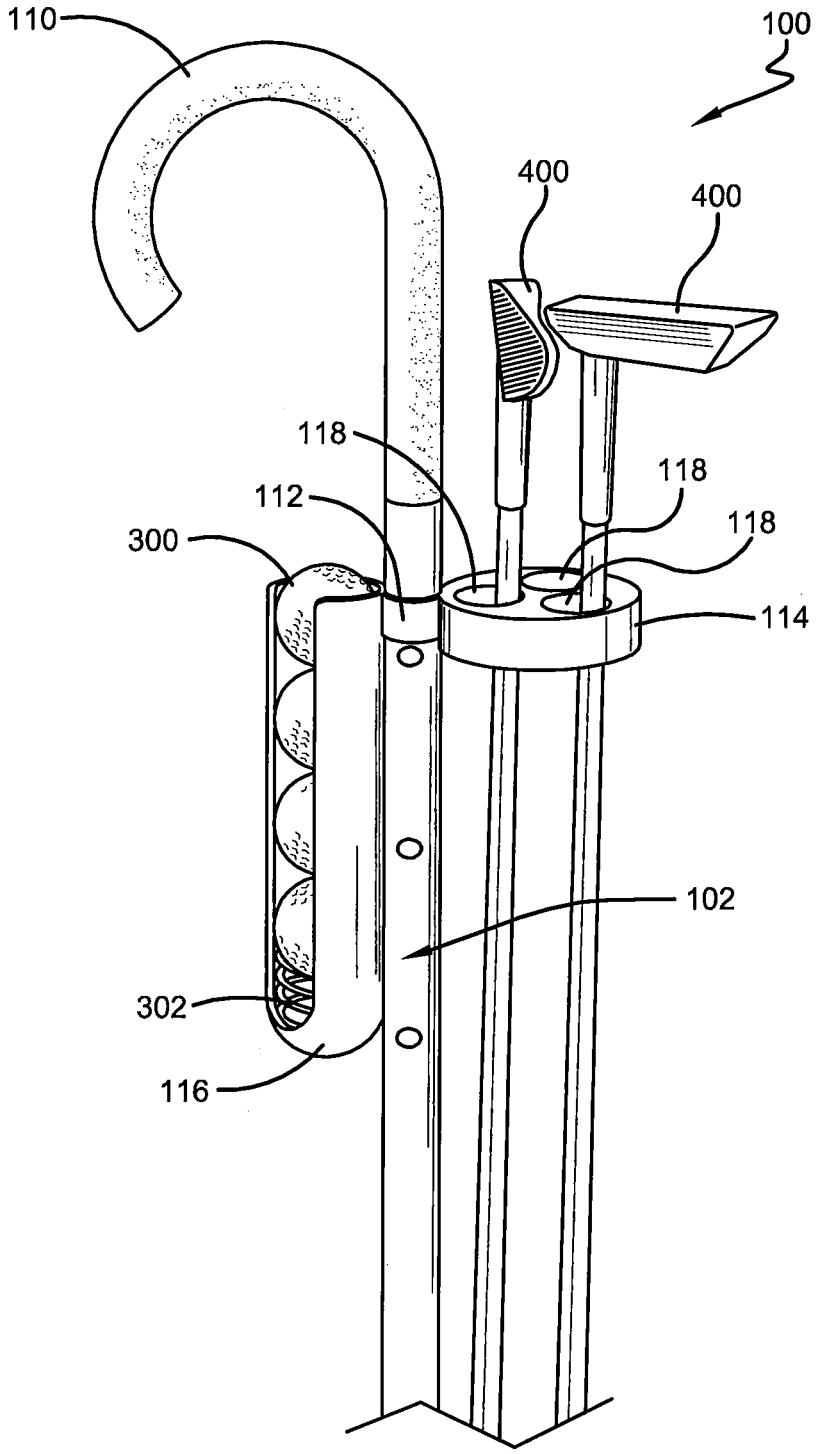
FIG. 4 illustrates a perspective view of the golf caddie device in use in accordance with the disclosed architecture.

Furthermore, the first cylinder 114 comprises three to five rings or openings 118, each of which is capable of retaining at least one golf club. More specifically, a golf club may be inserted through one of the openings 118 by inserting the shaft part of the golf club through one of the openings 118, allowing the head part of the golf club to protrude from the opening 118, and thus, retaining the golf club within the first cylinder 114, as shown in FIG. 4.

Additionally, the golf caddie device 100 can also comprise a second cylinder 122 secured to the second end 106 of the support rod 102. The second cylinder 122 is secured to the second end 106 of the support rod 102 via a fastening clasp 120 (See FIG. 6), frictional engagement, gluing, set screws, threading, welding, etc., or any other suitable fastening means as is known in the art. Typically, the second cylinder 122 is ring-like or circular in shape, however any other suitable shape can be used as is known in the art without affecting the overall concept of the invention. The second cylinder 122 would generally be constructed of aluminum or plastic, such as polycarbonate, polyvinyl chloride (PVC), polycarbonate (PC), or acrylonitrile butadiene styrene (ABS), though any other suitable material may be used to manufacture the second cylinder 122 as is known in the art without affecting the overall concept of the invention.

The second cylinder 122 retains at least one golf club in place. The second cylinder 122 comprises up to five indentations 124 (or blind holes), each of which is capable of retaining at least one golf club shaft. More specifically, a golf club may be inserted through one of the openings 118 of the first cylinder 114 by inserting the shaft part of the golf club through the opening 118 and into one of the indentations 124 of the second cylinder 122, thus, allowing the head part of the golf club to protrude outwardly from the opening 118, and retaining the golf club shaft within the indentations 124 of the second cylinder 122.

Typically, the first cylinder 114 and the second cylinder 122 are secured to the support rod 102 such that the openings 118 and the indentations 124 generally align. The alignment of the first cylinder 114 and the second cylinder 122 allows a golf club shaft to be inserted through an opening 118 of the first cylinder 114 and be retained in an indentation 124 of the second cylinder 122.

Additionally, the support rod 102 may comprise at least one wheel 600 secured to the second end 106 of the support rod 102. The wheels 600 aid the user in transporting the golf caddie device 100 by allowing the user to roll the device 100 along the ground.

Figure 2:
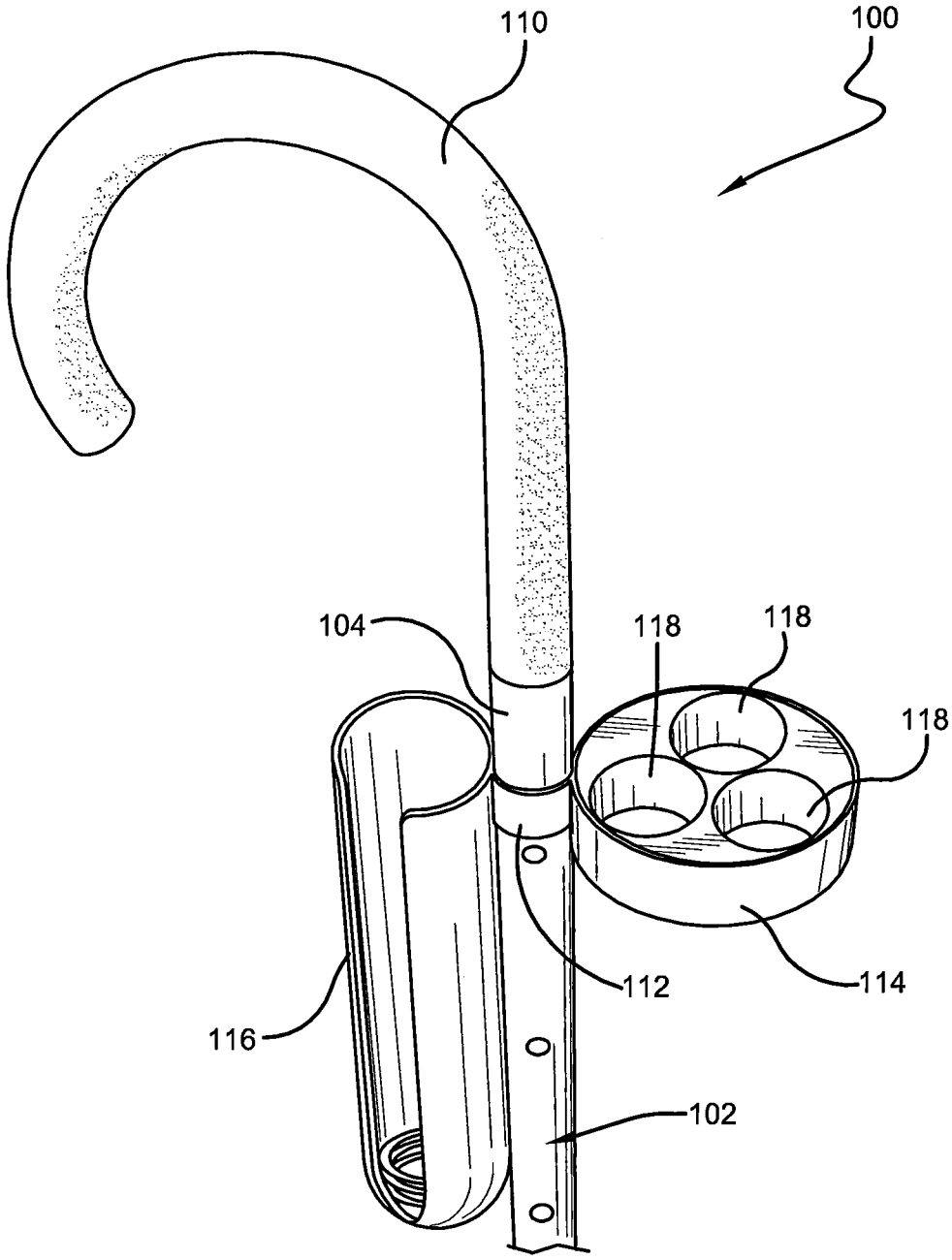
FIG. 2 illustrates a perspective view of the golf caddie device comprising a first cylinder and ball holder in accordance with the disclosed architecture.

FIG. 2 illustrates the golf caddie device 100 comprising a first cylinder 114 and ball holder 116. The first cylinder 114 is secured to the first end 104 of the support rod 102. Typically, the first cylinder 114 retains at least one golf club and a ball holder 116. The first cylinder 114 can also retain any other golf accessories as is known in the art such as golf towels, umbrellas, golf tees, ball markers, divot tools, a club head brush, etc.

The ball holder and/or dispenser 116 of the support rod 102 retains and dispenses multiple golf balls. The ball holder/dispenser 116 is spring-loaded to dispense the golf balls, such that when one golf ball is removed from the dispenser 116 another golf ball will rise up toward the top of the dispenser 116. In a preferred embodiment, the ball holder 116 comprises a sleeve 117 (See FIG. 6) which covers the ball holder 116, once the sleeve 117 is raised golf balls would be released or dispensed.

Furthermore, the first cylinder 114 comprises up to five rings or openings 118, each of which is capable of retaining at least one golf club. More specifically, golf clubs are inserted through one of the openings 118 by inserting the shaft part of the golf club through one of the openings 118, allowing the head part of the golf club to protrude from the opening 118, and thus, retaining the golf club within the first cylinder 114.

Figure 3:
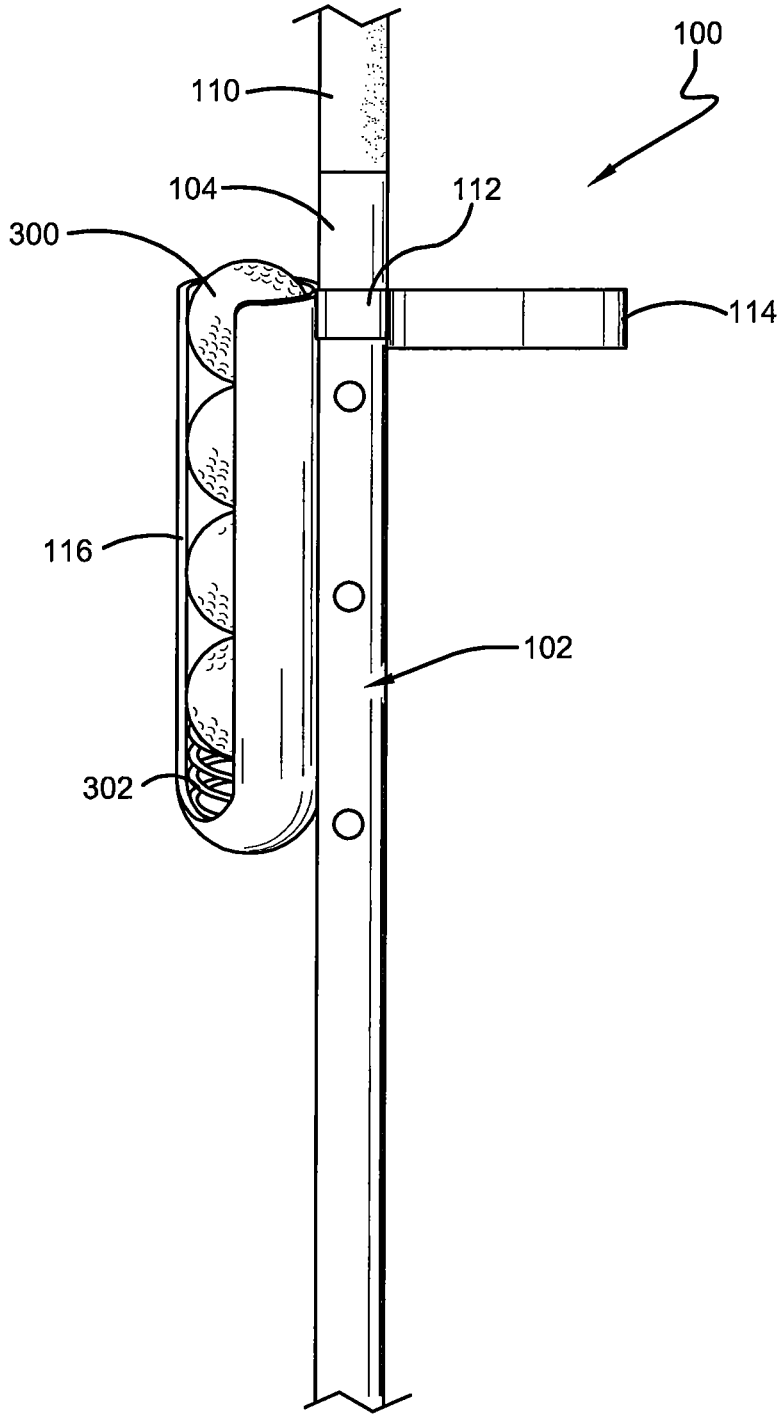
FIG. 3 illustrates a perspective view of a golf caddie device showing the ball holder in use in accordance with the disclosed architecture.

FIG. 3 illustrates a golf caddie device 100 showing the ball holder 116 in use. The ball holder and/or dispenser 116 of the support rod 102 retains and dispenses multiple golf balls 300, typically four to five golf balls 300, though any suitable number can be retained as is known in the art. The ball holder/dispenser 116 is spring-loaded to dispense the golf balls, such that when one golf ball is removed from the dispenser 116 another golf ball will rise up toward the top of the dispenser 116. Typically, the ball holder/dispenser 116 comprises a spring-loaded mechanism 302 as is known in the art. In a preferred embodiment, the ball holder 116 comprises a sleeve 117 (See FIG. 6) which covers the ball holder 116, once the sleeve 117 is raised golf balls would be released or dispensed.

Figure 5:
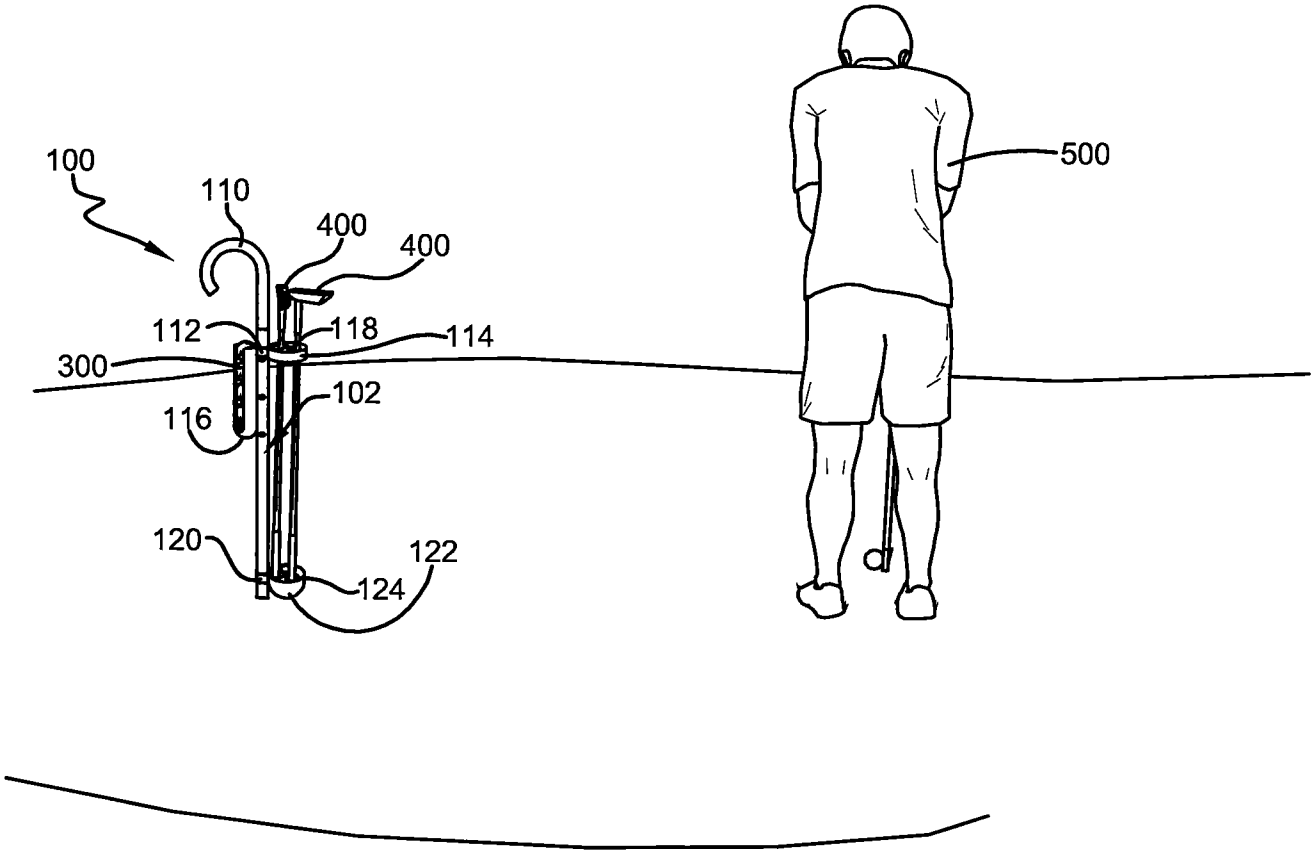
FIG. 5 illustrates a perspective view of the golf caddie device in use in accordance with the disclosed architecture.

FIGS. 4-5 illustrate the golf caddie device 100 in use. In operation, a user 500 would select a golf caddie device 100. A user 500 would then select a desired length for the golf caddie device 100, and would adjust the support rod 102 accordingly. A user 500 would then insert the desired number of golf clubs 400 into the openings 118 of the first cylinder 114. The golf clubs 400 are inserted through the openings 118 of the first cylinder 114 by inserting the shaft part of the golf club through one of the openings 118 and into the indentation 124 of the second cylinder 122, thus, allowing the head part of the golf club to protrude from the opening 118, and retaining the golf club shaft within the indentation 124 of the second cylinder 122.

The user 500 then loads a desired amount of golf balls into the ball holder and/or dispenser 116. The ball holder/dispenser 116 is spring-loaded to dispense the golf balls, such that when one golf ball is removed from the dispenser 116 another golf ball will rise up toward the top of the dispenser 116. However, in a preferred embodiment, the ball holder 116 comprises a sleeve 117 (See FIG. 6) which covers the ball holder 116, once the sleeve 117 is raised golf balls would be released or dispensed. The user 500 then utilizes the spike to allow the golf caddie device 100 to be inserted into the ground and remain relatively level while golfing. Further, when the user 500 is done golfing with the golf caddie device 100 or desires to transport the golf caddie device 100 to another location, the user 500 would fold up the spike and transport the golf caddie device 100. Additionally, the user 500 utilizes the ergonomically shaped handle to assist himself or herself when walking the golf course while carrying the golf caddie device 100. Furthermore, the golf caddie device 100 comprises wheels (not shown) which are secured to an end of the support rod 102. The wheels aid the user 500 in transporting the golf caddie device 100 by allowing the user to roll the device 100 along the ground.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A golf caddie device comprising:

a support rod comprising a first end and a second end; and a spike secured to the second end, and wherein the spike is repositionable between an open position and a closed position via a slide bolt;

a first cylinder comprising at least one opening for retaining at least one golf club, wherein the first cylinder is secured to the first end of the support rod; and a spring-loaded ball dispenser secured to the support rod which comprises a sleeve which covers the spring-loaded ball dispenser, wherein once the sleeve is raised golf balls are dispensed; and at least one wheel secured to the second end of the support rod for transporting the golf caddie device; and wherein the support rod is adjustable in length via a push pin that when pressed allows the support rod to telescope into or out, which adjusts length of the support rod.

2. The golf caddie device of claim 1, wherein the support rod further comprises an ergonomically shaped handle secured to the first end above the first cylinder.

3. The golf caddie device of claim 1, further comprising a second cylinder secured to the second end of the support rod.

4. The golf caddie device of claim 3, wherein the second cylinder comprises at least one opening for retaining at least one golf club in place.

5. The golf caddie device of claim 1, wherein the first cylinder comprises five openings for retaining golf clubs.

6. The golf caddie device of claim 1, wherein the ball dispenser dispenses one golf ball at a time.

7. A golf caddie device comprising:

a support rod comprising a first end and a second end;

a spike secured to the second end, and wherein the spike is repositionable between an open position and a closed position via a slide bolt;

a spring-loaded ball holder which comprises a sleeve which covers the spring-loaded ball dispenser, wherein once the sleeve is raised golf balls are dispensed;

a first cylinder comprising at least one opening for retaining at least one golf club, wherein the first cylinder is secured to the first end of the support rod; and a second cylinder comprising at least one opening for retaining at least one golf club shaft in place, wherein the second cylinder is secured to the second end of the support rod; and at least one wheel secured to the second end of the support rod for transporting the golf caddie device; and wherein the support rod is adjustable in length via a push pin that when pressed allows the support rod to telescope into or out, which adjusts length of the support rod.

8. The golf caddie device of claim 7, wherein the support rod further comprises an ergonomically shaped handle secured to the first end above the first cylinder.

9. A golf caddie device comprising:

a support rod comprising a first end and a second end with a spike secured to the second end, wherein the spike is repositionable between an open position and a closed position via a slide bolt;

a spring-loaded ball holder which comprises a sleeve which covers the spring-loaded ball dispenser, wherein once the sleeve is raised golf balls are dispensed;

a first cylinder comprising five openings for retaining five golf clubs, wherein the first cylinder is secured to the first end of the support rod; and a second cylinder comprising at least one opening for retaining at least one golf club shaft in place, wherein the second cylinder is secured to the second end of the support rod; and at least one wheel secured to the second end of the support rod for transporting the golf caddie device; and wherein the support rod is adjustable in length via a push pin that when pressed allows the support rod to telescope into or out, which adjusts length of the support rod.

10. The golf caddie device of claim 9, wherein the support rod further comprises an ergonomically shaped handle secured to the first end above the first cylinder.

* * * * *